US008550883B2

(12) United States Patent
Baumgartner et al.

(10) Patent No.: US 8,550,883 B2
(45) Date of Patent: Oct. 8, 2013

(54) ABRASION APPARATUS

(75) Inventors: Robert Anton Baumgartner, Traun (AT); Erwin Rinnerthaler, Salzburg (AT)

(73) Assignee: Wilhelm Anger, Salzburg (DE)

( * ) Notice: Subject to any disclaimer, the term of this patent is extended or adjusted under 35 U.S.C. 154(b) by 374 days.

(21) Appl. No.: 13/009,401

(22) Filed: Jan. 19, 2011

(65) Prior Publication Data

US 2011/0287696 A1 Nov. 24, 2011

(30) Foreign Application Priority Data

May 21, 2010 (EP) ..... 10163543

(51) Int. Cl.
*B24B 7/24* (2006.01)

(52) U.S. Cl.
USPC ..... 451/231; 451/42; 451/233

(58) Field of Classification Search
USPC ..... 451/42, 43, 44, 178, 179, 231, 233, 451/240, 255, 256, 277, 278
See application file for complete search history.

(56) References Cited

U.S. PATENT DOCUMENTS

| | | | | |
|---|---|---|---|---|
| 6,561,738 | B1 * | 5/2003 | Fujita et al. | 408/97 |
| 6,572,451 | B1 * | 6/2003 | Fujita et al. | 451/42 |

FOREIGN PATENT DOCUMENTS

| | | | |
|---|---|---|---|
| EP | 1332819 | A1 | 8/2003 |
| EP | 2019331 | A1 | 1/2009 |
| EP | 2090921 | A1 | 8/2009 |
| EP | 2105782 | A1 | 9/2009 |
| FR | 2865046 | A1 | 7/2005 |

* cited by examiner

*Primary Examiner* — Timothy V Eley
(74) *Attorney, Agent, or Firm* — Baker & Hostetler LLP

(57) ABSTRACT

An apparatus for machining a spectacle lens by abrasion of material in the area of a joining surface to be formed is provided. The apparatus comprises a tool provided with a cutting end face whose axis of rotation is movable in a forward direction relative to a holding device and covers a reference plane. The holding device comprises a support surface, a contact surface aligned perpendicularly thereto and a stop edge. The support surface and the contact surface extend perpendicularly to the reference plane and the stop edge extends perpendicularly to the support surface and in parallel to the reference plane and has a distance from the reference plane which is variable. The support surface is interrupted such that the projecting end face of the tool can be moved along the interruption. When provided at its machining position the lens rests on the support surface, contacts the contact surface and abuts with its edge against the stop edge. When the distance of the stop edge from the reference plane is adjusted to a value predetermined for the lens to be machined, the joining surface is formed by means of the tool exactly at the location of the joining surface predetermined for the lens.

12 Claims, 5 Drawing Sheets

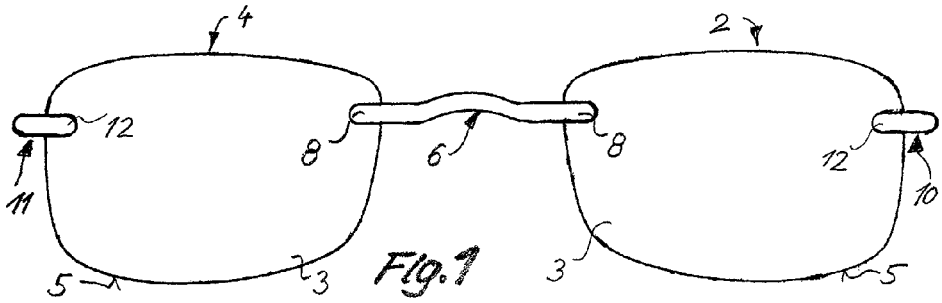
Fig. 1
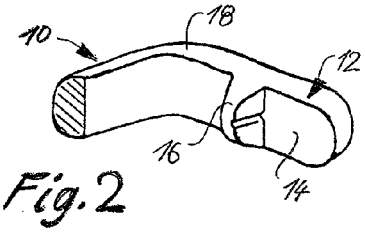
Fig. 2
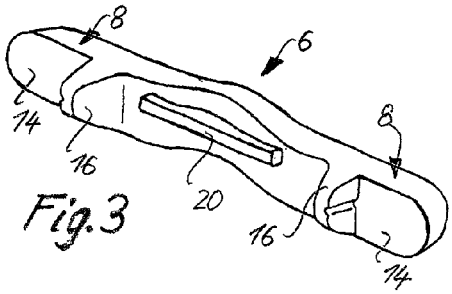
Fig. 3
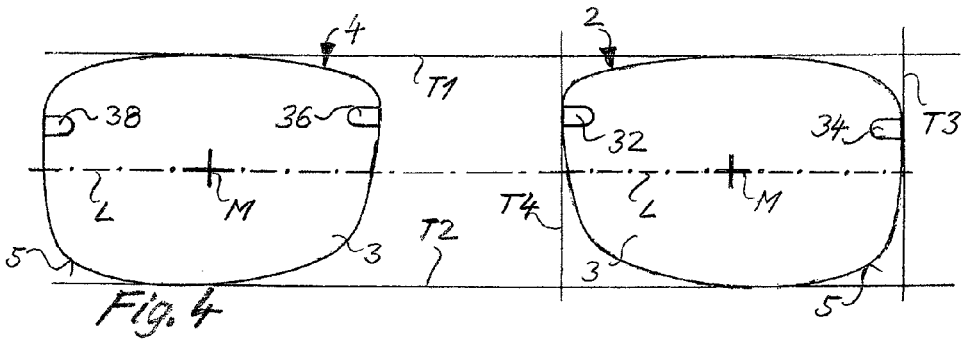
Fig. 4
Fig. 5
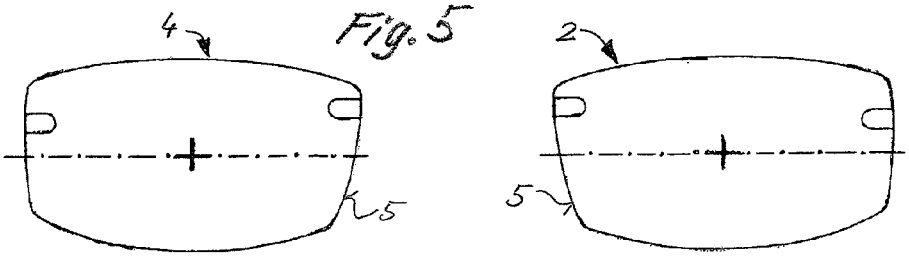

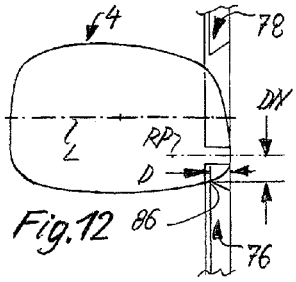
Fig.12
Fig.13
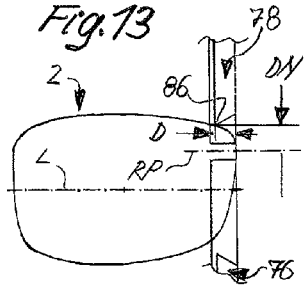
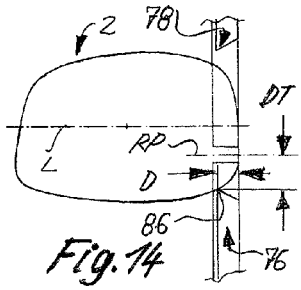
Fig.14
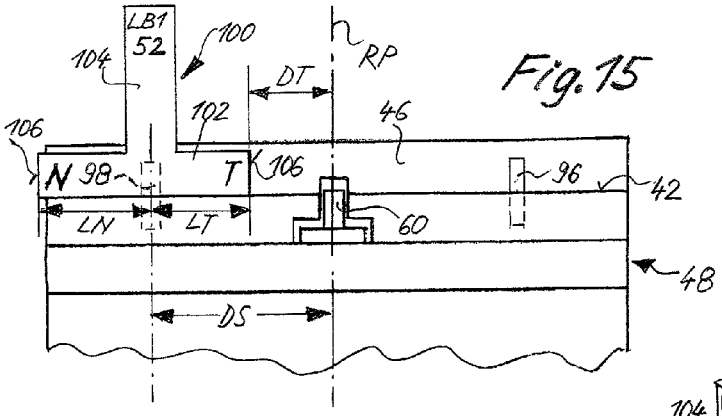
Fig.15
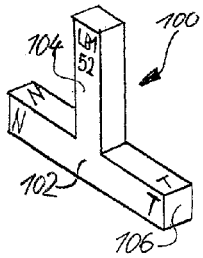
Fig.16
Fig.17
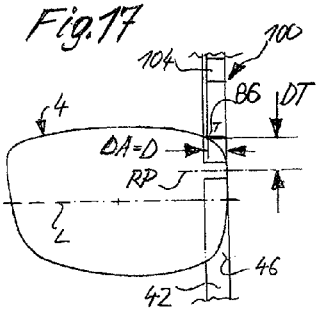
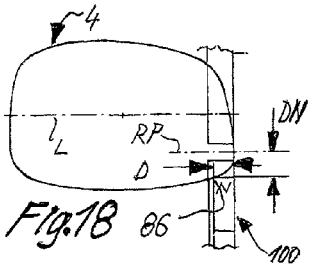
Fig.18
Fig.19
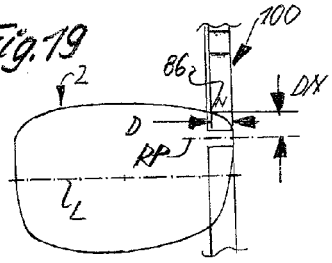
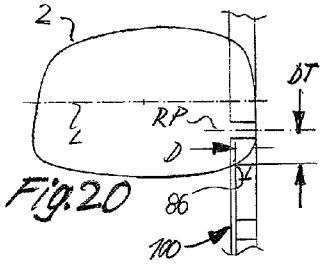
Fig.20

Fig. 21
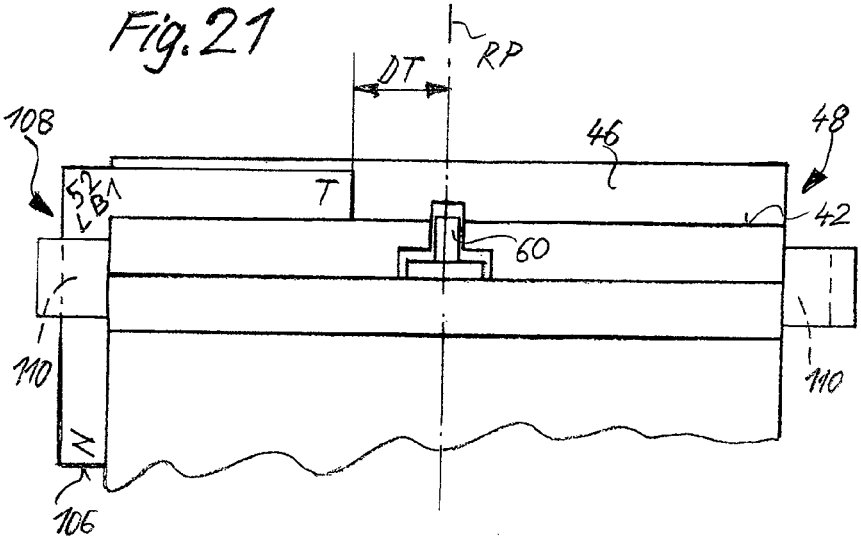
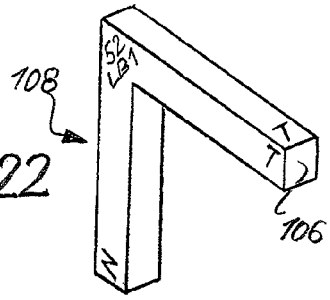
Fig. 22
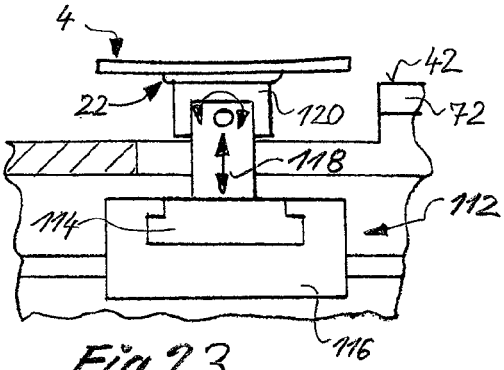
Fig. 23

ABRASION APPARATUS

CROSS-REFERENCE TO RELATED APPLICATIONS

This application claims priority to foreign Patent Application EP 101 63 543.1, filed on May 21, 2010, the disclosure of which is incorporated herein by reference in its entirety.

FIELD OF THE INVENTION

The invention relates to an apparatus for machining a spectacle lens of rimless spectacles, the machining being the abrasion of material on the front side of the spectacle lens in the area of joining surfaces to be formed.

BACKGROUND OF THE INVENTION

A method of manufacturing rimless spectacles is known in which connecting elements of the lugs and the bridge of the spectacles are adhesively bonded to the front sides of the lenses. In this known method firstly two lens blanks are fabricated of a plastic material to the front and rear sides of which a coating is applied. The two coated lens blanks are ground such that two spectacle lenses having a desired lens shape are obtained. At predetermined mounting positions for the connecting elements of the lugs and the bridge on the front side of the lenses the coating is removed to form joining surfaces substantially corresponding, as to shape and dimensions, to joining surfaces formed at the connecting elements. The connecting elements are then adhesively bonded to the front side of the lenses at the mounting positions. Since in the area of the joining surfaces at the spectacle lenses the base material thereof is exposed, a permanently tight adhesive bond can be produced between the connecting elements and the lenses.

Furthermore, an apparatus adapted to be employed in the afore-described method for forming the joining surfaces on the front sides of the lenses by local abrasion of the coating in the area of the joining surfaces is also known. This apparatus includes a mounting plate as well as a holding device for each lens of the spectacles to be manufactured with the aid of which the lens is fixed to the mounting plate such that its front side faces away from the mounting plate and is exposed. A grinding device comprises a drive unit and a tool supported by the drive unit in the form of a face grinder. Being controlled by a program control means the grinding device can be moved above the location at which an individual joining surface is to be formed, is lowered there until the end face of the face grinder contacts the lens with low pressing force and then locally abrades the coating in order to form a joining surface at the lens. It has turned out to be difficult to form the joining surfaces exactly at the positions predetermined for the same on the front side of the lens by means of the known apparatus.

SUMMARY OF THE INVENTION

Embodiments of the present invention advantageously provide an apparatus for machining a lens of rimless spectacles which permits to form joining surfaces at the lens with high accuracy at predetermined positions of the spectacle lens. The apparatus has a novel design and permits easy handling and operation.

Various embodiments of the present invention include the support surface, the contact surface and the hold-down device as well as the at least one stop edge. These elements are in a particular relation to the tool and the reference plane covered by the latter and permit by interaction to arrange and to hold or clamp the lens at such machining position that the tool exactly forms the joining surface to be formed at the location of the joining surface predetermined for the lens taking its lens shape into account.

BRIEF DESCRIPTION OF THE DRAWINGS

Hereinafter the invention is illustrated in detail by way of embodiments with reference to the drawings in which:

FIG. 1 shows a front view of an embodiment of rimless spectacles for the manufacture of which the apparatus can be employed;

FIG. 2 shows a perspective view of a left lug of the spectacles according to FIG. 1;

FIG. 3 shows a perspective view of a bridge of the spectacles according to FIG. 1, FIG. 4 illustrates the two lenses of the spectacles according to FIG. 1 in a front view;

FIG. 5 illustrates two lenses in a front view which differ by the lens shape from the lenses according to the FIGS. 1 and 4;

FIGS. 12 to 14 show, in a representation similar to FIG. 11, two lenses and elements of the apparatus during machining the lenses, the lenses being shown at different machining positions;

FIG. 15 is a cut-out schematic front view of a second embodiment of the apparatus;

FIG. 16 is a perspective representation of a stop member of the apparatus according to FIG. 15;

FIGS. 17 to 20 show, in a representation similar to the FIGS. 11 to 14, two lenses at different machining positions and associated elements of the apparatus according to FIGS. 15 and 16;

FIG. 21 is a cut-out schematic front view of a third embodiment of the apparatus;

FIG. 22 is a perspective representation of a stop member of the apparatus according to FIG. 21; and FIG. 23 is a cut-out and schematic view of a receiving device which can be provided in the apparatus.

DETAILED DESCRIPTION

Figure 6:
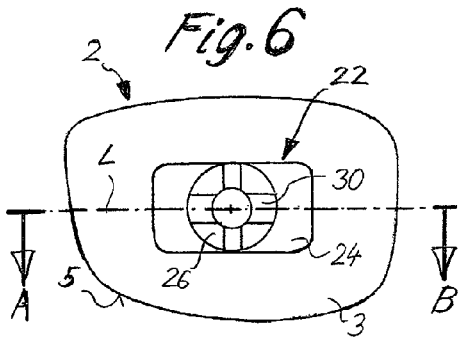
FIG. 6 is a front view of a lens of the spectacles according to FIG. 1 in connection with the lens holder after grinding the lens shape at the lens.

Hereinafter, first of all an embodiment of rimless spectacles is illustrated by way of the FIGS. 1 to 4 and 6 to 8 for the manufacture of which the apparatus according to the invention can be employed.

FIG. 1 shows two lenses as well as further elements of rimless spectacles when viewed from the front. The spectacles comprise a left lens 2, a right lens 4 and a bridge 6 disposed between the two lenses. In the present explanation of the spectacles the terms “left” and “right” refer to the respective information about the human head. Accordingly, the left lens 2 is associated with the left eye and shown on the right in FIG. 1, for instance. Each of the two lenses 2 and 4 has a front side 3 visible in FIG. 1, a rear side not visible in FIG. 1 which faces the respective eye of the spectacles wearer having the spectacles put on and a circumferential edge 5 which radially outwardly delimits the lens. The bridge 6 is an elongate element being disposed between the two eyeglass lenses 2 and 4 and interconnecting the same and at each of its two ends includes a connecting element 8 which is adhesively bonded to the front side 3 of the lens 2 or 4 visible in FIG. 1. Further, the spectacles have a left lug 10 and a right lug 11. Each of the lugs is fastened to a marginal area of the lens 2 or 4 facing away from the bridge. For this purpose, each of the two lugs has at its front end a connecting element 12 which is adhesively bonded to the front side 3 of the lens 2 or 4. Each of the lugs is articulated to a side of the eyeglasses not shown in FIG. 1.

FIG. 2 illustrates, in an enlarged and cut-out perspective view when viewed slanted from above and behind, the left lug 10 including its connecting element 12. The connecting element 12 of the left lug is substantially block-shaped and on its rear side includes a joining surface 14 visible in FIG. 2 which is substantially plane and has a rectangular shape whose one side is rounded as is shown in FIG. 2. The joining surface 14 is intended to be adhesively bonded to a joining surface on the front side 3 of the left lens 2. The connecting element 12 further includes a projection 16 arranged adjacent to the joining surface 14 and extending to the rear which is designed to contact the edge 5 of the lens. The connecting element 12 merges into a curved portion 18 of the lug 10 connecting the connecting element 12 to the joint not shown at which the lug 10 is connected to the left side of the spectacles which is not shown.

The above explanation of the left lug 10 is applicable mutatis mutandis to the right lug 11 of the spectacles.

FIG. 3 illustrates the bridge 6 enlarged in a perspective view when viewed slanted from above and behind. As regards the configuration of the connecting elements 8 of the bridge 6, the foregoing explanation of the connecting element 12 of the lug 10 is applicable. Accordingly, each of the two connecting elements 8 of the bridge 6 includes the joining surface 14 and the projection 16 arranged adjacent thereto. In the central portion of the bridge 6 a rail 20 is integrally formed with the aid of which a pad member not shown in the FIGS. 1 and 3 can be mounted to the bridge 6, the pad member serving for supporting the spectacles at the wearer's nose.

In the afore-described embodiment of rimless spectacles the bridge including its two connecting elements and the lugs including their connecting element are each parts that are integrally injection-molded of a plastic material. Deviating from this, the respective connecting elements 8 and 12, on the one hand, and the other portions of the bridge 6 and the two lugs 10 and 11, on the other hand, can consist of materials different from each other and can have been interconnected before adhesively bonding the connecting elements to the spectacle lenses or can be interconnected after adhesively bonding the connecting elements to the spectacle lenses. It is possible, for instance, to injection-mold the respective connecting element at the remaining portion of the bridge or lug during an injection-molding process and to partly or completely cover the remaining portion with the material of the connecting element. Irrespective of the remaining configuration and the manufacturing method of the bridge and the lugs, it is essential that at the respective connecting element the joining surface 14 is formed which is designed to be adhesively bonded to a complementary joining surface on the front side of either of the two lenses.

Each of the two lenses 2 and 4 usually has been made of a coated lens blank having a circular edge. On its front side and its rear side the lens blank is provided with a coating which usually consists of plural layers and is to ensure scratch resistance and/or influence on the reflection properties and/or dirt-repelling properties of the surfaces of the lens.

FIG. 4 shows the two lenses 2 and 4 of the spectacles according to FIG. 1 again when viewed from the front, wherein the joining surfaces illustrated in detail further below and formed on the front sides 3 of the two lenses 2 and 4 are visible, because the bridge 6 and the lugs 10 and 11 of the spectacles are not shown in FIG. 4. The geometric design of the edge 5 of the two lenses 2 and 4 when viewed from the front (or the rear) is referred to as lens shape. Numerous different lens shapes are known and possible with rimless eyeglasses. The FIGS. 1 and 4 show the lenses 2 and 4 with merely one of numerous possible and known lens shapes.

FIG. 5 shows, in a representation similar to FIG. 4, two lenses 2 and 4 the lens shape of which is visibly different from the lens shape of the lenses in FIG. 4 and thus shows an example of a further one of the numerous possible and known lens shapes.

Each lens has a geometric center M which coincides—when viewing the lens from the front or from behind—with the center of a rectangle referred to as box. This box is illustrated hereinafter by way of the left lens 2 shown in FIG. 4. The box is defined by an upper tangent T1 to the edges of the two lenses 2 and 4, a lower tangent T2 to the edges of the two lenses 2 and 4 as well as an outer tangent T3 and an inner tangent T4 to the edge of the lens 2, the tangents T3 and T4 extending perpendicularly to the tangents T1 and T2. A straight line connecting the centers M of the two lenses 2 and 4 constitutes the center line L of each of the two lenses 2 and 4.

In order to manufacture the lenses 2 and 4 with the desired lens shape, for instance the one shown in FIGS. 1 and 4, usually a lens holder also referred to as block or adhesive block is detachably bonded to the front side of the lens blank, wherein an axis of rotation of the lens holder extends perpendicularly through the front side of the lens blank and through the geometric center M of the predetermined lens shape of the lens to be manufactured. While the lens blank is rotated about the axis of rotation of the lens holder, starting from the edge of the lens blank so much material is removed from the same by grinding dependent on the rotary position of the lens blank that the spectacle lens having the desired lens shape is obtained. The state reached in this way is exemplified for the left lens 2 in the FIGS. 6 and 7.

FIG. 6 shows, when viewed from the front, the left lens 2 together with the lens holder 22 adhesively bonded to the front side 3 of the lens 2 after grinding the edge 5 with the desired lens shape.

Figure 7:
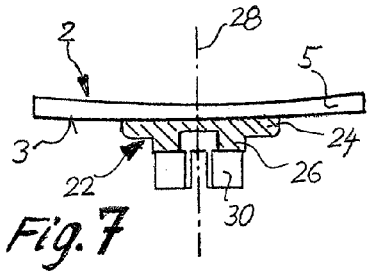
FIG. 7 is a sectional view according to A-B in FIG. 6.

FIG. 7 illustrates the lens 2 and the lens holder 22 in a section according to A-B in FIG. 6.

The lens holder 22 comprises a substantially rectangular or oval plate 24 and a pintle 26 centrally arranged thereto. With its free surface the plate 24 is adhesively bonded to the lens 2. In the pintle 26 a hole is formed for defining the axis of rotation 28 of the lens holder 22. At the lens holder 22 means are formed that have a defined relation to the center line L of the lens 2. In the example of the lens holder 22 shown in FIGS. 6 and 7 these means are constituted by a longitudinal groove 30 extending in a direction in parallel to the center line L of the lens 2.

As already described in the foregoing, the bridge and the lugs of the spectacles are adhesively bonded to the lenses 2 and 4. For this purpose, on the front sides 3 of the lenses 2 and 4 joining surfaces are formed, wherein at the lenses for each of the joining surfaces 14 of the connecting elements 8 and 12 a respective joining surface is provided. Accordingly, at the left lens 2 a joining surface 32 is provided for the left connecting element 8 of the bridge 6 as well as a joining surface 34 is provided for the connecting element 12 of the left lug 10 and at the right lens 4 a joining surface 36 is provided for the right connecting element 8 of the bridge 6 as well as a joining surface 38 is provided for the connecting element 12 of the right lug 11. Hereinafter the two joining surfaces 32 and 36 are also referred to as nasal joining surfaces, because they are provided close to the nose of the spectacles wearer with put on spectacles, and the two joining surfaces 34 and 38 are also referred to as temporal joining surfaces, as they are provided in the area of the temples with put on spectacles. The four joining surfaces at the lenses 2 and 4 are substantially equal, as to shape and dimensions, to the joining surface 14 of the respective connecting element 8 or 12 which is adhesively bonded to the lens. In other words this means that the joining surfaces at the lenses, on the one hand, and the joining surfaces at the connecting elements, on the other hand, are designed to be complementary to one another.

The joining surfaces at the lenses 2 and 4 have been formed at the same by the fact that in the area of the joining surfaces to be formed the coating has been removed completely, i.e. at least up to the total thickness of the coating, on the front side of the respective lens. The purpose of removing the coating consists in exposing the base material of the lenses so that the respective joining surface at the lens has the material constitution of the base material of the lens. This is a prerequisite for the manufacture of a permanently tight adhesive bond between the connecting elements and the lenses.

FIG. 8 shows, again when viewed from the front, an enlarged view of the left lens 2 of the viewed embodiment of the rimless spectacles. In this embodiment the joining surfaces on the front side of the lens 2 or 4 start out from the edge 5 of the lens or extend up to this edge. Each of the joining surfaces is confined by two straight lines parallel to the center line L of the lens whose distance from each other defines the width B of the joining surface, as this is shown for the temporal joining surface 34 in FIG. 8. At its end facing the geometric center M each of the joining surfaces is confined by a semicircle. A joining surface center line FM extends centrally between the two straight edges of each joining surface, as this is equally illustrated in FIG. 8.

The location of each joining surface at the lenses is predetermined and set by the design of the spectacles along with the lens shape of the lenses 2 and 4. The location of the temporal joining surface 34 is predetermined such that the joining surface center line FM thereof intersects the tangent T3 in the contact point thereof at the edge 5 of the lens 2 or close to said contact point. The location of the nasal joining surface 32 at the left lens 2 is predetermined such that the joining surface center line FM thereof intersects the tangent T4 at the contact point thereof at the edge 5 or close to said contact point.

Figure 8:
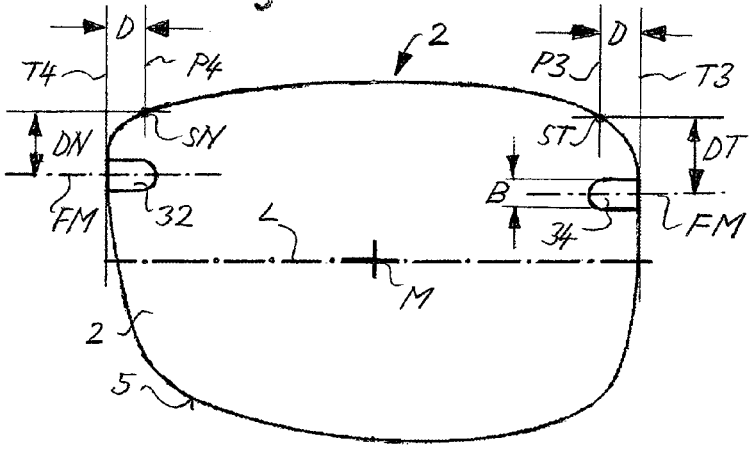
FIG. 8 is an enlarged front view of a left lens of the spectacles according to FIG. 1 to illustrate the geometric relations between joining surfaces of the lens and the edge thereof.

In FIG. 8 a parallel P3 extending in parallel to the tangent T3 is inserted which has the distance D from the tangent T3 and intersects the edge 5 of the lens 2 at an intersection ST. The intersection ST has the distance DT from the joining surface center line FM of the temporal joining surface 34. Furthermore, in FIG. 8 a parallel P4 extending in parallel to the tangent T4 is inserted which has the distance D from the tangent T4 and intersects the edge 5 of the lens 2 at an intersection SN. The intersection SN has the distance DN from the joining surface center line FM of the nasal joining surface 32. The intersections ST and SN are preferably located on the same side of the center line L as the joining surfaces. Concerning FIG. 8 this means that both the joining surfaces 32 and 34 and the intersections ST and SN are located above the center line L and that the intersections ST and SN are located on the upper portion of the edge 5 of the lens 2. The values of the distance D are preferably equal for the nasal joining surface and usually are within the range of from 2 to 5 mm.

The afore-mentioned explanations about the left lens by way of FIG. 8 apply mutatis mutandis to the right lens 4, because in the embodiment of the rimless spectacles according to FIG. 1 the left half and the right half thereof are formed symmetrically to each other. The distance DN is the same for the two nasal joining surfaces 32 and 36 and the distance DT is the same for the two temporal joining surfaces 34 and 38.

When the lens shape of the lenses and the locations of the joining surfaces are predetermined or set at the same, thus the distances DT and DN are simultaneously predetermined or set with a given or chosen value of the distance D. The predetermined distances DT and DN define the locations of the joining surface center lines FM. Depending on the predetermined lens shape and predetermined locations of the joining surfaces, the distance DT can assume different values and usually assumes different values. This applies mutatis mutandis to the distance DN.

When, in the course of manufacture of the rimless spectacles, the nasal joining surfaces 32 and 36 and the temporal joining surfaces 34 and 38 are to be formed, this is to be done with high accuracy, i.e. each joining surface is to be formed as accurately as possible at the predetermined location. It has been found that this high accuracy required can be reached while exploiting the afore-explained geometric relation between the intersection ST and the temporal joining surface and the geometric relation between the intersection SN and the nasal joining surface. In the apparatus according to the invention, these geometric relations are exploited.

Hereinafter, especially with respect to the FIGS. 9 to 14 a first embodiment of the apparatus according to the invention is explained. This apparatus serves for machining the lenses of rimless spectacles of the afore-described type, the machining being constituted by forming the lateral and nasal joining surfaces by abrasion of the coating on the front side of the lenses in the area of the joining surfaces to be formed. The coating is abraded at least up to its entire thickness, wherein it is harmless when some base material of the lenses is also abraded.

Figure 9:
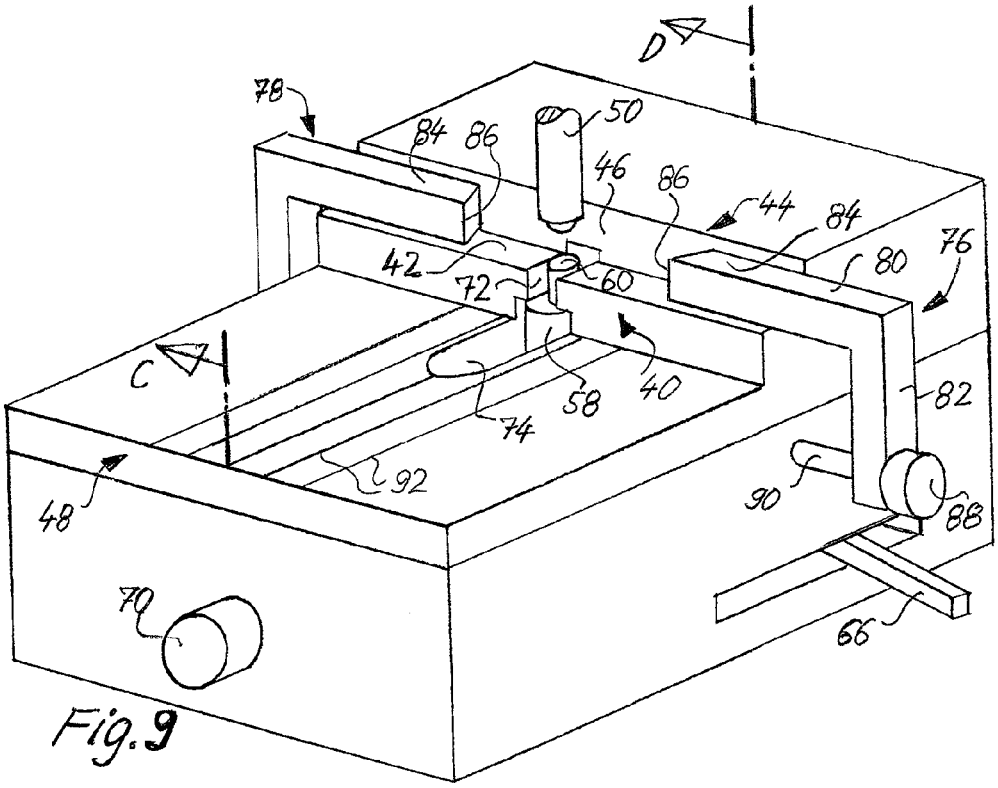
FIG. 9 is a schematic perspective view of a first embodiment of the apparatus when viewed slanted from above and from the front.

FIG. 9 schematically shows a perspective view of the embodiment when viewed slanted from above and from the front.

Figure 10:
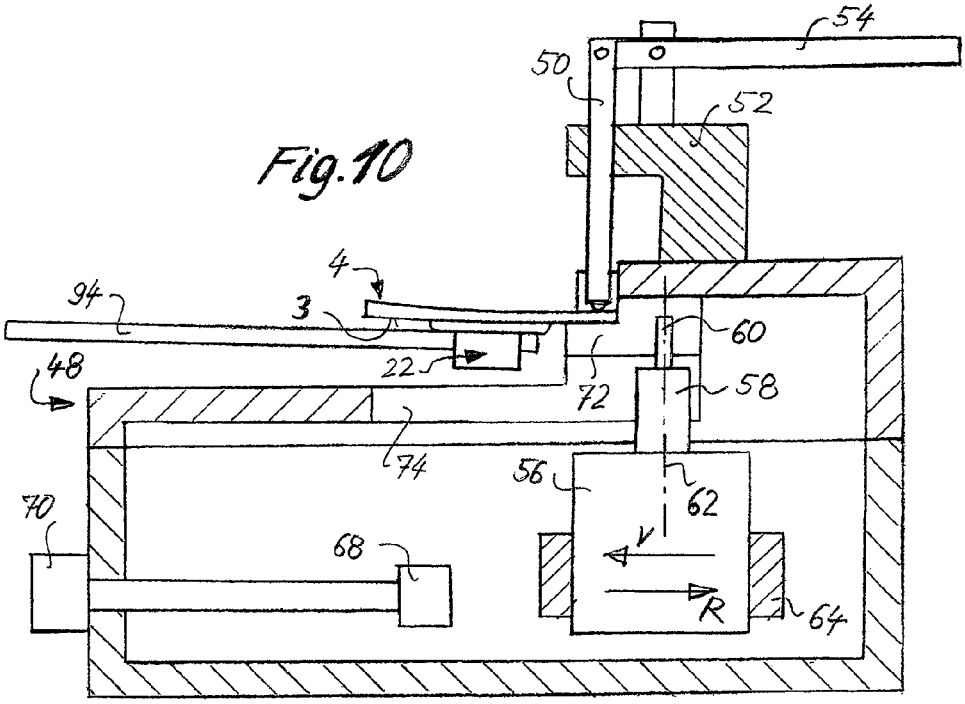
FIG. 10 is a schematic sectional view of the first embodiment of the apparatus in a section according to C-D in FIG. 9.

FIG. 10 is a schematic sectional view according to C-D in FIG. 9, wherein FIG. 10 shows the apparatus in connection with a lens to be machined.

The apparatus according to the shown embodiment comprises a housing and a holding device for holding a lens at or in the apparatus. The holding device includes a support member 40 at which a plane, substantially rectangular support surface 42 is formed, a contact member 44 at which a plane, substantially rectangular contact surface 46 is formed as well as a hold-down device. The support surface 42 and the contact surface 46 are adjacent to each other and include a right angle between them. For the purpose of the present description, the support surface 42 visible in FIG. 9 is considered to be a horizontally aligned surface and accordingly "vertically" denotes an extension perpendicularly to the horizontal support surface 42. Correspondingly, the contact surface 46 is a surface extending vertically upward from the support surface 42.

In the shown embodiment the support member 40 and the contact member 44 are formed integrally at an upper housing part 48 supporting the hold-down device. The hold-down device comprises a hold-down rod 50, a guide 52 and an operating lever 54, the guide 52 and the operating lever 54 being shown merely schematically in FIG. 10 but not in FIG. 9. The hold-down rod 50 is guided vertically in the guide 52 and is held by the guide 52 such that an elastic element disposed at the lower end of the hold-down rod 50 is provided approximately centrally above the support surface 42. A spring that is not shown acts upon the hold-down rod 50 in a downward direction. By means of the operating lever 54 the hold-down rod 50 can be lifted against the force of the spring.

In a manner described further below, a lens, for instance the right lens 4, can be placed with a marginal area onto the support surface 42 and can be disposed with its edge 5 against the contact surface 46 and pressed at this position against or onto the support surface 42 by means of the hold-down rod 50 so that the lens is clamped or chucked between the support member 40 and the hold-down rod 50 and in this way the holding device can exert its holding function. Accordingly, the holding device can also be referred to as chucking means or as clamping means.

Within the housing of the apparatus a drive unit 56 is arranged which includes an electric motor on the shaft of which a chuck 58 is seated. In the chuck 58 a tool 60 is inserted which, in the shown embodiment, is a face cutter the cutting end face of which is formed at the upper end of the tool 60 in the FIGS. 9 and 10 and has a diameter equal to the width B of the joining surfaces to be formed. Alternatively, the tool 60 can also be a face grinder whose end face includes abrasive particles. By means of the drive unit 56 the tool 60 can be rotated about the axis of rotation 62 thereof.

The drive unit 56 is mounted to a carriage 64 shown merely schematically in FIG. 10 by means of which the drive unit 56 can be moved or displaced horizontally within the apparatus on rails not shown here. During this movement the tool 60 is displaced or moved relative to the holding device, the axis of rotation 62 of the tool 60 covering or defining a plane which is referred to as reference plane RP for the purpose of the present invention. This reference plane RP coincides with the plane of projection of FIG. 10 and is visible in a top view in FIG. 11. The elements of the holding device and the rails for the carriage of the drive unit 56 are arranged in or at the apparatus relative to each other such that the support surface 42 and the contact surface 46 extend perpendicularly to the reference plane RP and that the axis of rotation 62 of the tool 60 extends vertically and thus perpendicularly to the support surface 42.

The tool 60 is moved in a direction normal to its axis of rotation 62 when the drive unit 56 is moved or displaced. The direction of movement of the tool 60 to the left in FIG. 10 is the forward direction V of the tool and the direction of movement of the tool 60 opposed thereto is the return direction R thereof. In the housing of the apparatus an operating member 66 is pivoted which projects from the housing and is articulated to the carriage 64 such that by pivoting the operating member 66 the carriage 64 and the drive unit 56 are moved and thus the tool 60 is forwarded or returned in the forward direction V and the return direction R. As an alternative to the manually operable operating member 66, there can be provided an electric actuator not shown here which is coupled to the carriage 64 and is adapted to drive the latter in forward and return direction. Within the housing of the apparatus a stop 68 is disposed whose position is adjustable in the direction of movement of the carriage 64 by means of a hand wheel 70. During the forward movement the carriage 64 abuts against the stop 68 so that the range of movement of the carriage 64 and thus again of the tool 60 is limited in the forward direction in an adjustable manner by the stop 68.

A slot 72 interrupting the support surface 42 approximately centrally is formed in the support member 40. The slot 72 has a width in the area of the support surface 42 which is somewhat larger than the diameter of the end face of the tool 60 and extends in the direction of movement of the tool 60 so that during its forward movement the tool can enter the slot 72. When the tool 60 is disposed in the slot 72, the end face of the tool 60 is disposed somewhat above the support surface 42. The degree of projection of the end face of the tool 60 with respect to the end face 42 can be adjusted. A simple possibility of adjusting the degree of projection is to shift the tool 60 within the chuck 58 vertically into the desired position and to fix it at this position in the chuck 58. The degree of projection of the end face of the tool 60 defines the depth up to which, in a direction normal to the front side of the lens, material is abraded in the area of a joining surface. Accordingly, the projection is adjusted corresponding to the desired abrading depth, wherein the desired abrading depth is at least so great that the coating is abraded up to its entire thickness on the front side of the lens.

The slot 72 merges into a recess 74 formed in the upper housing part 48 which permits to move the drive unit 56 into the forward direction V so far that the chuck 58 and the tool 60 adopt a position outside the slot 72 and left from the support surface 42 in FIG. 10. At this position the chuck 58 and the tool 60 project upward from the upper side of the upper housing part 48 so that they are freely accessible. At this position the tool 60 can be exchanged and its vertical position can be adjusted in the chuck 58. The hold-down rod 50 is disposed at the apparatus such that its elastic element is provided above the slot 72.

In order to distinguish the areas on the one and the other side of the reference plane RP, the area provided in the front in FIG. 9 in which the operating member 66 is arranged is referred to as right area and an element located in the right area or a position provided there is referred to as right element or right position, where appropriate. Accordingly, the area located on the other side of the reference plane is referred to as left area and elements and positions provided there are referred to as left elements or left positions.

A right stop member 76 and a left stop member 78 are associated with the holding device of the embodiment shown in FIGS. 9 and 10. The right stop member 76 comprises a substantially block-shaped leg 80 extending horizontally and a substantially block-shaped leg 82 extending vertically. The leg 80 is supported on the support surface 42, extends perpendicularly to the reference plane RP and at a front portion 84 facing the reference plane RP includes an end face limited by an edge hereinafter referred to as stop edge 86. The stop edge 86 extends linearly and perpendicularly to the support surface 42. At its end facing away from the reference plane RP the leg 80 merges into the leg 82 extending vertically downward upon which an actuator having a hand wheel 88 and an adjusting spindle 90 acts. The adjusting spindle 90 is engaged in a spindle nut not shown which is fixed to the apparatus. By means of the hand wheel 88 the stop member 76 can be moved in a direction normal to the reference plane RP, whereby the distance of the stop edge 86 from the reference plane RP can be varied and adjusted. When moving the stop member 76, it can be guided with the aid of guide means not shown so as to ensure that the distance of the stop edge 86 from the contact surface 46 does not vary while the distance of the stop edge 86 from the reference plane RP is adjusted and varied.

The foregoing explanation of the right stop member 76 applies mutatis mutandis also to the left stop member 78. The left stop member 78 equally includes the stop edge 86 extending linearly and perpendicularly to the support surface 42 and having an adjustable and variable distance from the reference plane RP.

Hereinafter, with reference to the FIGS. 11 to 14, it is explained in which way the lenses of the rimless spectacles can be machined by means of the afore-described apparatus, i.e. in which way the joining surfaces can be formed at the same. First of all, it is illustrated by way of FIG. 11 in which way the temporal joining surface 38 is formed at the right lens 4.

It has been explained already before by way of FIG. 8 that the location of each joining surface center line FM can be determined by setting the distance DT or DN of the joining surface center line FM from the intersection ST or SN of a parallel at a distance D from the tangent T3 or T4 at the edge 5 of the lens 2 or 4. The two stop members 76 and 78 are dimensioned such that the distance of their stop edge 86 from the contact surface 46, hereinafter referred to as distance DA, is equal to the distance D. It is insignificant in this context whether first the distance D is chosen and then the stop members 76 and 78 are manufactured such that DA=D, or whether first the distance DA is set and then the distances DN and DT are established for D=DA.

Figure 11:
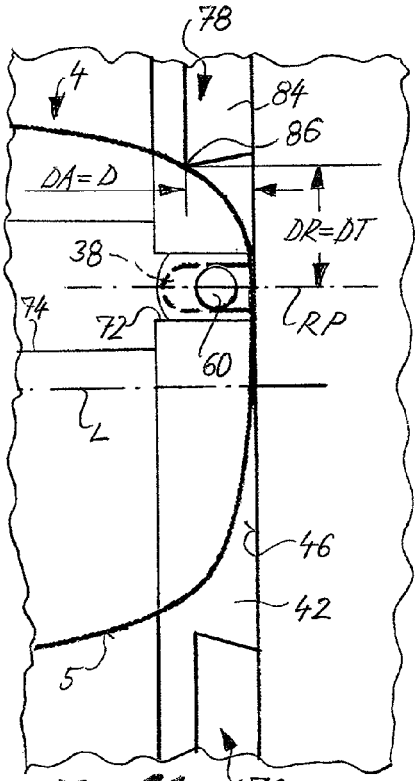
FIG. 11 is a cut-out top view on the apparatus according to the FIGS. 9 and 10 during machining a right lens of the spectacles according to FIG. 1 by means of the apparatus.

FIG. 11 shows a cut-out and a top view of the apparatus according to the FIGS. 9 and 10 in the area of the slot 72 interrupting the supporting surface 42. Further, in FIG. 11 a part of the lens 4 to be machined is shown in its machining position, wherein the elements and contours visible within the edge 5 of the lens 4 are viewed through the lens.

Before the lens 4 is brought into the machining position shown in FIG. 11, the stop edge 86 of the left stop member 78 is adjusted by means of the actuator associated with the left stop member 78 such that the distance of the stop edge 86 from the reference plane RP, hereinafter referred to as distance DR, is equal to the distance DT. Then the lens 4 is put onto the support surface 42 with the front side of the marginal area in which the joining surface 38 is to be formed, wherein simultaneously the edge 5 of the lens 4 is made to contact the contact surface 46 and the stop edge 86. Further, the lens 4 is aligned such that its center line L extends in parallel to the reference plane RP. When the state is reached in which the center line L extends in parallel to the reference plane RP and the edge 5 contacts the contact surface 46 and abuts against the stop edge 86, the hold-down rod 50 of the hold-down device held in a lifted position before is lowered so that the lens 4 is clamped between the support surface 42 and the elastic element of the hold-down rod 50 and in this way the lens is clamped and held at its machining position at or in the holding device. The right stop member 76 is adjusted such that the stop edge thereof does not contact the lens 4 at its machining position. Because of DA=D and DR=DT, at the machining position of the lens 4 the geometric relations between the edge 5 of the lens and the distances D and DT illustrated by way of FIG. 8 are reproduced so that the joining surface center line FM of the joining surface to be formed is located in the reference plane RP in which also the axis of rotation of the tool 60 is located. FIG. 11 and FIG. 10 show the lens 4 at its machining position.

In order to facilitate aligning the lens relative to the holding device in the way that the center line L of the lens 4 extends in parallel to the reference plane RP, the upper housing part 48 can be provided with auxiliary lines 92 extending in parallel to the reference plane RP (cf. FIG. 9). During positioning the lens 4 at and in the holding device, a lens holder 22 of the type described by way of FIGS. 6 and 7 is preferably provided on the front side of the lens 4. This can be the lens holder 22 which holds the lens during grinding its edge or a similar lens holder which again has been adhesively bonded to the front side 3 of the lens 4 for the purpose of positioning the lens at the apparatus. A straight rod 94 which can serve both for handling the lens and for aligning the center line L thereof in parallel to the reference plane RP is clamped into the longitudinal groove 30 of the lens holder 22 (cf. FIG. 10).

While the lens 4 is held at its machining position shown in FIG. 11, the tool 60 supported by the drive unit 56 is moved out of the idle position of the tool 60 and the drive unit 56 shown in FIG. 10 in the forward direction V by means of the operating member 66. Unless the drive unit 56 has been switched on before already, it is switched on during this movement so that the tool 60 is rotated. As soon as the tool during the forward movement impinges on the edge 5 of the lens 4, the abrasion of material starts on the front side of the lens 4 up to a depth corresponding to the projection of the end face of the tool 60 from the support surface 42. The FIGS. 9 and 11 show the tool 60 at an intermediate position during machining the lens. The forward movement of the tool 60 stops, when the carriage 64 reaches the stop 68 which is adjusted such that the joining surface 38 has been formed up to a predetermined length. After that the tool 60 is returned in return direction R to the idle position and the lens 4 is released and removed from the holding device.

It is possible in the afore-described way to form the joining surface 38 with high accuracy at the location predetermined for the same at the lens 4. It is a substantial reason of this high accuracy that at the apparatus the geometric relations predetermined for the lens by the intersection ST or SN, the tangent T3 or T4 and the joining surface center line FM can be reproduced by means of the stop edge 86, the contact surface 46 and the reference plane RP (cf. FIG. 8). The stop edge 86 contacting the edge 5 while the lens contacts the stop edge 86 corresponds to the intersection ST or SN.

In the foregoing, it has been explained by way of FIG. 11 in which way the temporal joining surface 38 is formed at the right lens 4. The FIGS. 12 to 14 illustrate in the same top view as FIG. 11 the machining positions of the lenses 2 and 4 during formation of the other joining surfaces 32, 34 and 36. The machining positions illustrated in the FIGS. 11 to 14 have in common that the lens 2 or 4 is supported, with the front side of the marginal area of the lens in which the joining surface is to be formed, on the support surface 42 and that the lens 2 or 4 with its edge 5 contacts the contact surface 46. Furthermore, the machining positions have in common that the center line L of the respective lens extends in parallel to the reference plane RP and perpendicularly to the contact surface 46.

In FIG. 12 the right lens 4 adopts the machining position for forming its nasal joining surface 36. The stop edge 86 of the right stop member 76 against which the lens 4 abuts with its edge 5 is utilized for this purpose. The distance DR of the stop edge 86 of the right stop member 76 from the reference plane RP is adjusted to the distance DN in this case. The left stop member 78 and its stop edge are spaced apart from the lens 4. FIG. 13 shows the left lens 2 at the machining position for its nasal joining surface 32. In this case, the left stop member 78 with its stop edge 86 is utilized against which the edge of the lens 2 abuts. In contrast to the adjustment of the left stop member 78 shown in FIG. 11, in the case shown in FIG. 13 the distance DR is adjusted to the distance DN. The right stop member 76 and its stop edge are spaced apart from the lens 2.

FIG. 14 illustrates the left lens 2 at the machining position for its temporal joining surface 34. In this case, the right stop member 76 with its stop edge 86 is employed against which the left lens 2 abuts with its edge, wherein—other than in the case of FIG. 12—the distance DR is adjusted to the distance DT, however. The left stop member 78 and its stop edge are spaced apart from the lens 2. At each of the machining positions shown in the FIGS. 12 to 14 the material is abraded for forming the respective joining surface in the same way as this has been explained in the foregoing by way of FIG. 11. Thus, all four joining surfaces of the two lenses 2 and 4 are formed at the lenses with high accuracy.

Depending on the lens shape and on predetermined locations of the joining surfaces at the lenses, the values of the distance DN and the distance DT are different. In the afore-described apparatus the distance DR of the respectively used stop edge 86 from the reference plane RP is infinitely variable so that it can be adjusted to different values of DN and DT. Accordingly, the apparatus is suited for machining lenses having numerous lens shapes different from each other and locations of the joining surfaces predetermined for the same.

In the afore-described first embodiment the stop edge used during the machining of a lens is formed at a stop member guided and held movably at the remaining apparatus so that the distance of the stop edge from the reference plane can be varied and adjusted by adjusting the position of the stop member. In this respect, a second embodiment of the apparatus described hereinafter differs from the first embodiment. In the second embodiment the stop edge is formed at a stop member that can be detachably mounted at the remaining apparatus, wherein the distance of the stop edge from the reference plane is variable by the fact that the stop member is adapted to be mounted to the remaining apparatus with orientations different from each other. For the rest, the foregoing explanations concerning the first embodiment are applicable to the second embodiment.

Hereinafter the second embodiment is illustrated in detail with reference to the FIGS. 15 to 20. FIG. 15 shows a cut-out of the apparatus according to the second embodiment in a front view corresponding to the view when viewed from the left in FIG. 10, wherein the elements of the down-hold device are not shown. In the support member 40 a right pin 96 and a left pin 98 are inserted which are aligned perpendicularly to the support surface 42 and are arranged symmetrically with respect to the reference plane RP so that their distances DS from the reference plane RP are equal. The stop member 100 shown in FIGS. 15 and 16 includes a block-shaped base 102 and a handle portion 104 extending centrally vertically therefrom upward. The block-shaped base 102 is provided with two rectangular end faces 106 parallel to each other and includes a bore permitting to put the stop member 100 onto one of the pins 96 and 98 and to thereby mount it to the apparatus. FIG. 15 shows the stop member 100 in its state mounted to the left pin 98. In the mounted state the two end faces 106 extend in parallel to the reference plane RP and two of the sides of the end face 106 facing the reference plane RP extend perpendicularly to the support surface 42 so that the side of this end face 106 farther away from the contact surface 46 can be employed as stop edge and fulfils the function of the stop edge 86 explained before in connection with the first embodiment. The dimensions of the stop member 100 and the position of the pins 96 and 98 are chosen such that in the mounted state of the stop member 100 the side of either of the two rectangular end faces 106 serving as stop edge 86 has the distance DA from the contact surface 46.

The one of the two end faces 106 which is used for forming a temporal joining surface and, for this reason, is referred to as temporal end face and is marked with "T" in the FIGS. 15 and 16 exhibits the distance LT from the axis of the bore in the base 102 intended for receiving the pin 98. The one of the two end faces 106 which is used for forming a nasal joining surface and, correspondingly, is referred to as nasal end face and is marked with "N" in the FIGS. 15 and 16 exhibits the distance LN from the axis of the bore. The stop member 100 is dimensioned such that:

$$LT=DS-DT, \text{ and}$$

$$LN=DS-DN.$$

DN and DT are the distances in the case of a particular lens shape explained by way of FIG. 8, for instance the lens shape identified by the abbreviation LB1/52, which is why this abbreviation is also found at the stop member 100.

The stop member 100 can be mounted at the left position shown in FIG. 15 at the remaining apparatus, wherein it is oriented such that either the temporal end face 106 faces the reference plane RP, as this is shown in FIG. 15, or the nasal end face faces the reference plane RP. Furthermore, the stop member 100 can be mounted by means of the right pin 96 at the right position at the remaining apparatus, the stop member 100 being oriented such that either its temporal end face or its nasal end face faces the reference plane RP.

The FIGS. 17 to 20 illustrate in a similar representation as the FIGS. 11 to 14 the lenses 2 and 4 at their respective machining positions for the nasal and temporal joining surfaces. At the same time, these Figures illustrate the stop member 100 at its respective position and orientation. In FIG. 17 the right lens 4 is shown at its machining position for the temporal joining surface 38. The stop member 100 is provided at its left position which is also shown in FIG. 15, and the stop member 100 is oriented such that its temporal end face faces the reference plane RP. The lens abuts against the side of this end face facing away from the contact surface 46 so that the latter side of the end face in this case constitutes the stop edge 86. The distance DA of the stop edge 86 from the contact surface 46 is equal to the distance D afore-illustrated by way of FIG. 8. The distance of the stop edge 86 from the reference plane RP is equal to the distance DT because of the distance relationships explained by way of FIG. 15.

FIG. 18 shows the right lens 4 at its machining position for the nasal joining surface 36. The stop member 100 is provided at its right position, wherein the nasal end face of the stop member 100 faces the reference plane RP and the one side of this end face forms the stop edge 86 against which the lens abuts. The distance of this stop edge 86 from the reference plane RP is equal to the distance DN. In FIG. 19 the left lens 2 adopts its machining position for the nasal joining surface 32. The stop member 100 is provided at its left position, wherein the nasal end face of the stop member 100 faces the reference plane RP and the side of the nasal end face facing away from the contact surface 46 forms the stop edge 86 whose distance from the reference plane RP is equal to the distance DN. FIG. 20 shows the left lens 2 at its machining position for the temporal joining surface. The stop member 100 adopts its right position, wherein the temporal end face faces the reference plane RP and the side of this end face facing away from the contact surface 46 forms the stop edge 86.

In all four machining positions of the spectacle lenses illustrated in the FIGS. 17 to 20 the center line L thereof is aligned in parallel to the reference plane RP. For the rest, the foregoing explanations concerning the FIGS. 11 to 13 apply mutatis mutandis.

As it is resulting from the foregoing description of the second embodiment, by resetting and useful orienting the stop member 100 at the remaining apparatus the stop edge 86 can be arranged at all locations relative to the reference plane RP which are required for forming all four joining surfaces of the two lenses 2 and 4. However, when using only one single stop member 100, the joining surfaces can be formed for a particular lens shape only, viz. the lens shape to the values of the distances DT, DN and D of which the dimensions of the stop member 100 are adjusted. Therefore, it is preferably provided that the respectively employed stop member 100 is one of plural similar stop members of a set of stop members which are different as regards the values of their distances LT and/or LN and of the distance DA, where appropriate, wherein each of these stop members is associated with a particular one of plural different lens shapes and is used when lenses having said particular lens shape are to be machined.

The FIGS. 21 and 22 show, in a representation similar to the FIGS. 15 and 16, a third embodiment of the apparatus according to the invention. Just as the second embodiment, the third embodiment is provided with a stop member 108 detachably mountable to the remaining apparatus which can be mounted to the remaining apparatus at the left position and at the right position and can be differently oriented in each case. The third embodiment differs from the second embodiment substantially as regards the configuration of the stop member. The stop member 108 of the third embodiment comprises two legs disposed at right angles with respect to each other at the free ends of which a respective one of the rectangular end faces 106 is formed to which the explanation about the end faces 106 of the second embodiment applies mutatis mutandis.

On the left side of the apparatus a vertically extending slot 110 is formed into which each of the two legs of the stop member 108 can be inserted in vertical direction without play. A similar slot 110 is formed on the right side of the apparatus.

FIG. 21 illustrates the stop member 108 at its left position and in one of the two orientations possible at the left position. The leg of the stop member 108 provided with the nasal end face is inserted into the left slot 110 and the leg of the stop member 108 provided with the temporal end face is supported on the support surface 42, the dimensions of the stop member 108 being such that the temporal end face and its two sides perpendicular to the support surface 42 exhibit the distance DT from the reference plane RP. When the leg including the temporal end face is inserted into the slot 110 and the leg including the nasal end face faces the reference plane RP, the nasal end face and its two sides perpendicular to the support surface 42 have the distance DN from the reference plane RP. When the stop member 108 is inserted with one of its two legs into the right slot 110 and the stop member 108 adopts its right position, conditions are resulting which are analogous to the those explained in the foregoing concerning the stop member 108 at its left position. The geometric relations between the lenses at their machining positions illustrated by way of the FIGS. 17 to 20 and the respective stop edge 86 are equally applicable to the third embodiment and therefore are not explained again.

When making use of the afore-described embodiments of the apparatus the lens is aligned, while being positioned in and at the holding device, in such way that its center line L extends in parallel to the reference plane RP of the apparatus. This aligning operation is carried out manually by the operator while he observes, for instance, the course of the rod 94 (cf. FIG. 10) in relation to the auxiliary lines 92. In order to relieve the operator from this aligning operation, each of the afore-described embodiments can be provided with a receiving device which holds the lens to be machined such that its center line L always extends in parallel to the reference plane RP. An embodiment of such receiving device is shown in FIG. 23 which is a cut-out and schematic representation in a section according to C-D in FIG. 9, i.e. in the same sectional plane as in FIG. 10.

The receiving device illustrated in FIG. 23 comprises a cross table 112 movable or displaceable as a whole within the device substantially perpendicularly to the contact surface 46. An upper part 114 of the cross table 112 is horizontally movable or displaceable at the lower part 116 thereof substantially perpendicularly to the reference plane RP. The upper part 114 supports a guide member 118 which is guided substantially vertically movably at the upper part 114 with a spring force directed vertically upward acting on the same. At the upper end of the guide member 118 a receiving member 120 is arranged which is pivoting relative to the guide member about a pivot axis extending substantially perpendicularly to the reference plane RP. The receiving member 120 is formed such that it is adapted to receive a lens holder 22 of the type described in FIGS. 6 and 7.

The lens holder 22 received by the receiving member 120 or inserted in the receiving member 120 is fixedly held by the receiving member 120, i.e. held in such fashion that the lens holder 22 cannot rotate at the receiving member 120 about the axis of rotation 28 of the lens holder 22. The receiving member 120 holds the lens holder 22 at such position that the center line L of the lens adhesively bonded to the glass holder 22 extends in parallel to the reference plane RP.

By reason of the afore-described configuration of the receiving device, the latter holds the lens holder 22 and the lens 4 mounted thereto such that the lens can be moved or displaced two-dimensionally in a plane normal to the reference plane RP and the axis of rotation 62 of the tool, that the lens can be moved or displaced in a direction perpendicular to the support surface 42 and that the lens can be pivoted about a pivot axis perpendicular to the reference RP. With these movements the center line L of the lens always remains aligned in parallel to the reference plane RP, however. In this way, the lens disposed at the receiving device can perform all movements required to bring it into its machining position in and at the holding device. With these movements the center line L of the lens always remains aligned in parallel to the reference plane RP so that the operator need not take care of this alignment.

The apparatus described in the foregoing by way of the embodiments for forming joining surfaces at the lenses of rimless spectacles is comparatively simple in terms of design and permits a simple and reliable handling and operation. It permits in particular to form the joining surfaces exactly at the locations at the lenses provided for the joining surfaces. The apparatus is suited for forming the joining surfaces at the lenses for numerous different lens shapes and locations of the joining surfaces predetermined for the respective lens shape.

In the afore-described embodiments of the apparatus the holding device for holding the lens to be machined is formed to be fixed to the apparatus and the drive unit 56 and the tool 60 supported by the same are movable or displaceable. Deviating from this the drive unit 56 and the tool 60 can be arranged fixed to the apparatus and the holding device can be movable relative to the tool 60 in the forward direction V and the return direction R. This mobility can be achieved in the described embodiments by the fact, for instance, that the upper housing part 48 thereof including the elements of the holding device disposed thereon and the at least one stop member disposed thereon is movably guided at the lower housing part.

The invention is not restricted to the described embodiments.

The apparatus for machining a spectacle lens by abrading material in the area of a joining surface to be formed comprises a tool provided with a cutting end face whose axis of rotation is movable relative to a holding device in a forward direction while covering a reference plane. The holding device comprises a support surface, a contact surface aligned perpendicularly thereto and a stop edge. The support surface and the contact surface extend perpendicularly to the reference plane and the stop edge extends perpendicularly to the support surface and in parallel to the reference plane and exhibits a distance from the reference plane which is variable. The support surface is interrupted such that the projecting end face of the tool can be moved along the interruption. When provided at the machining position, the lens is supported on the support surface, contacts the contact surface and with its edge abuts against the stop edge. When the distance of the stop edge from the reference plane is adjusted to a value predetermined for the lens to be machined, the joining surface is formed exactly at the location of the joining surface predetermined for the lens by means of the tool.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An apparatus for machining a lens of rimless spectacles, comprising:

a holding device to hold the lens, a tool in the form of a face cutter or face grinder; and a drive unit, supporting the tool, to rotate the tool about an axis of rotation, wherein the holding device comprises two plane surfaces aligned at right angles with respect to each other, wherein a first one of the two plane surfaces is formed at a support member and constitutes a support surface, wherein a second one of the two plane surfaces is formed at a contact member and constitutes a contact surface, wherein a hold-down device is configured to press the lens when located on the support surface against the contact surface, wherein the drive unit supports the tool such that the axis of rotation thereof extends perpendicularly to the support surface, wherein the holding device and the tool are movable relative to each other in such a manner that during the relative movement the axis of rotation of the tool covers a reference plane relative to the holding device, wherein the support surface and the contact surface extend perpendicularly to the reference plane, wherein a slot is formed in the support member which interrupts the support surface and into which the tool can enter during the relative movement between the holding device and the tool, wherein at least one stop member includes a stop edge that is associated with the holding device, and wherein the stop edge extends perpendicularly to the support surface and has a presettable distance from the contact surface as well as a distance from the reference plane, the distance of the stop edge from the reference plane being variable.

2. The apparatus according to claim 1, wherein the holding device is arranged to be fixed to the apparatus and that the drive unit and the tool are arranged at a movable carriage so that the relative movement between the holding device and the tool is performed by moving the carriage.

3. The apparatus according to claim 2, wherein a manually operable operating member is coupled to the carriage for moving the carriage.

4. The apparatus according to claim 2, wherein a servomotor is coupled to the carriage for moving the carriage.

5. The apparatus according to claim 2, further comprising an adjustable stop for limiting the range of movement of the carriage.

6. The apparatus according to claim 1, wherein two stop members, each including a respective stop edge, are associated with the holding device, wherein one of the two stop members is disposed at one side of the reference plane and the other of the two stop members is disposed at the other side of the reference plane, and wherein each of the two stop members can be movably arranged such that the distance of the stop edge of each respective stop member from the reference plane is varied by moving the stop member into a changed position.

7. The apparatus according to claim 6, wherein each of the two stop members includes a front portion having an end face facing the reference plane, wherein an edge of the end face forms the stop edge, and wherein the front portion is movable in a direction normal to the reference plane by means of an actuator.

8. The apparatus according to claim 7, wherein the actuator includes an adjusting spindle and a manually operable hand wheel.

9. The apparatus according to claim 1, wherein the at least one stop member is selected from a set of a plurality of stop members each of which is detachably mountable to the apparatus, wherein the stop members of the set differ from each other in the distances between their respective stop edge and the reference plane, and wherein a mounted member of the set of a plurality of stop members can be exchanged with another member of the set.

10. The apparatus according to claim 9, wherein each stop member of the set has two rectangular end faces, one end face facing the reference plane and extending parallel thereto when the stop member is mounted, wherein each stop member is mountable to the apparatus on either side of the reference plane, and wherein each stop member is additionally mountable for varying the distance of the stop edge from the reference plane on each side of the reference plane such that either rectangular end face of the stop member faces the reference plane.

11. The apparatus according to claim 1, wherein the at least one stop member is detachably mountable to the apparatus and has two rectangular end faces one of which faces the reference plane and extends in parallel thereto in the mounted state of the stop member, wherein the stop member is mountable to the apparatus on either side of the reference plane of the reference plane and is additionally mountable for varying the distance of the stop edge from the reference plane on each side of the reference plane such that either rectangular end face of the stop member faces the reference plane.

12. The apparatus according to claim 1, further comprising a receiving member at which the lens is detachably fixed and a cross table supporting the receiving member, wherein the cross table is movable in a plane of motion perpendicular to the reference plane and the axis of rotation of the tool, and wherein the cross table supports the receiving member in such a manner that the receiver is movable at the cross table in a direction parallel to the axis of rotation of the tool and is further pivotable about a pivot axis perpendicular to the reference plane.

* * * * *